US006226840B1

(12) United States Patent
Lu

(10) Patent No.: US 6,226,840 B1
(45) Date of Patent: May 8, 2001

(54) STRUCTURE BINDER CLIP

(76) Inventor: Wann-Pao Lu, No. 38, Shann-Yih Lane., Yeong-Jing Hsiang, Chang-Hua Hsien (TW)

( * ) Notice: Subject to any disclaimer, the term of this patent is extended or adjusted under 35 U.S.C. 154(b) by 0 days.

(21) Appl. No.: 09/368,517

(22) Filed: Aug. 5, 1999

(51) Int. Cl.[7] ..... B42F 1/04
(52) U.S. Cl. ..... 24/67.5; 24/558
(58) Field of Search ..... 24/508, 553, 554, 24/557, 558, 565, 67.3, 67.5, 67.9; D8/395; D19/86

(56) References Cited

U.S. PATENT DOCUMENTS 467,244 * 1/1892 Ballard .
1,435,917 * 11/1922 Ensign .
1,965,554 * 7/1934 Mainwaring .
2,259,505 * 10/1941 Wisdom .
4,696,081 * 9/1987 Yen .

FOREIGN PATENT DOCUMENTS

868055 * 12/1941 (FR) ..... 24/67.5
344187 * 3/1931 (GB) ..... 24/558
673029 * 5/1952 (GB) ..... 24/558

* cited by examiner

*Primary Examiner*—James R. Brittain
(74) *Attorney, Agent, or Firm*—Dougherty & Troxell

(57) ABSTRACT

A binding clip having actuator rods capable of rotation to any angle so as to not impair reading and writing, and which is produced by a simpler fabrication process. A triangularly folded pincer section has an actuator rod on each of the two sides and an insertion hole punched in each of the two sides. An even number of oppositely facing limiter notches are formed along the inner circumference of the insertion holes and a rounded guide element is disposed in between each of the limiter notches, providing for the rotation to any angular degree of the actuator rods along the rounded guide elements. The actuator rods consist of U-shaped rod structures with the two ends bent to an appropriate angular degree and having catch hooks extending from the bent sections. By pressing the two sides of the actuator rods inwardly, the catch hooks can engage opposing pairs of limiter notches such that the actuator rods remain fullly pivotable while positioned in the limiter notches.

2 Claims, 4 Drawing Sheets

STRUCTURE BINDER CLIP

BACKGROUND OF THE INVENTION

1) Field of the Invention

The invention herein relates to an improved structure binder clip, wherein an insertion hole is punched in each of the two sides of the pincer section and, furthermore, an even number of oppositely facing limiter notches are formed along the inner circumference of the insertion hole and a rounded guide element is disposed in between each of the limiter notches, thereby providing for the rotation of the actuator rods along the rounded guide elements. The actuator rods have two ends bent to an appropriate angular degree and, furthermore, the resulting catch hooks extending from the bent sections formed on the two ends of the actuator rods, by means of the metallic resilience produced by pressing the two sides of the actuator rods inward, enable the catch hooks to become engaged into opposing pairs of limiter notches and, furthermore, the actuator rods remain fully pivotable while positioned in the limiter notches. As such, the improved structure binding clip of the invention herein does not adversely affect reading and writing and, furthermore, its die fabrication is simpler.

2) Description of the Prior Art

Conventional binder clips are utilized to hold printed or written note paper for reading so that the sheets of paper do not become scattered, temporarily lost, or cause a disorderly desktop.

In a conventional binder clip structure, as indicated in FIG. 1, the said binder clip 3 is comprised of a pincer section 51 having a hinge fold 511 formed by rolling the two binding ends outward to accommodate the respective insertion of the outwardly bent catch hook 521 formed at the two ends of the actuator rod 52, which is typically accomplished by squeezing the two sides inward and relying on the tensile metallic reverse force to engage the catch hooks 521 of the actuator rod 52 into the hinge folds 511 and thereby conveniently installing the actuator rod 52 to achieve object binding capability; however, when actually utilized, the conventional binding clip structure is not as ideal as expected and the overall shortcomings may be concluded as follows:

1. Affects Reading and Writing

When sheets of printed material or note paper are held together by the binding clip, due to the forward and backward pivoting characteristics of the actuator rods 52, the pincer section forms an excessive protuberance, with the left and right portions of the said sheets remaining uneven and unsecurable, which leads to positional writing difficulties; furthermore, if the actuator rods 52 are pivoted downward, although the pincer section is less obtrusive and writing is easier, the actuator rods 52 are pressed against the surface of the paper sheets and still affect reading and writing at this position.

2. Die Fabrication Difficulty

In the conventional binding clip, outwardly rolled hinge folds must be formed on the binding edges in order to fasten the actuator rods 52 to the pincer section 51, with the bending into shape of the tubular hinge sections 511 involving the fabrication of a die for continuous press forming that requires additional time and, furthermore, is relatively more complex to finish.

In view of the said shortcomings, which lead to the various utilization inconveniences today, the inventor of the invention herein conducted extensive research, including repeated tests and refinements during that period, which culminated in the successful development of an improved structure binding clip that completely eliminates the said shortcomings of the conventional product and, furthermore, is capable of greater practical performance.

SUMMARY OF THE INVENTION

The primary objective of the invention herein is to provide an improved structure binding clip that does not affect reading and writing which is comprised of an insertion hole punched in each of the two sides of the pincer section and, furthermore, an even number of oppositely facing limiter notches are formed along the inner circumference of the insertion hole with a rounded guide element disposed in between each of the limiter notches and actuator rods each having their two ends bent to an appropriate angular degree and, furthermore, having catch hooks extending from the bent sections formed on the two ends, with the catch hooks capable of becoming engaged into opposing pairs of limiter notches and, furthermore, capable of rotation to any angular degree along the rounded guide elements between the limiter notches as well as remaining fully pivotable while positioned in the pincer section, thereby circumventing the excessive protuberance shortcoming of the pincer section in the conventional binding clip due to the fixed upward or downward pivoting range of its hinged actuator rods and, furthermore, reading and writing by the user is not impaired after the actuator rods are pivoted down.

Another objective of the invention herein is to provide an improved structure binding clip that allows simpler and more convenient fabrication. Since the pincer section and the actuator rods are engaged together in a manner that only requires the punching of the insertion holes in the pincer section and the appropriate bending of the actuator arms, it is not necessary to form the hinge folds on the pincer section of the conventional binding clip, a shortcoming that involves greater punch die difficulty during fabrication and as such, die fabrication is simpler in the improved structure binding clip of the invention herein.

To enable the examination committee to further understand the structure, innovations, function, and other practical objectives of the present invention, the brief description of the drawings below are followed by the detailed description of the embodiments.

DETAILED DESCRIPTION OF THE EMBODIMENTS

Figure 1:
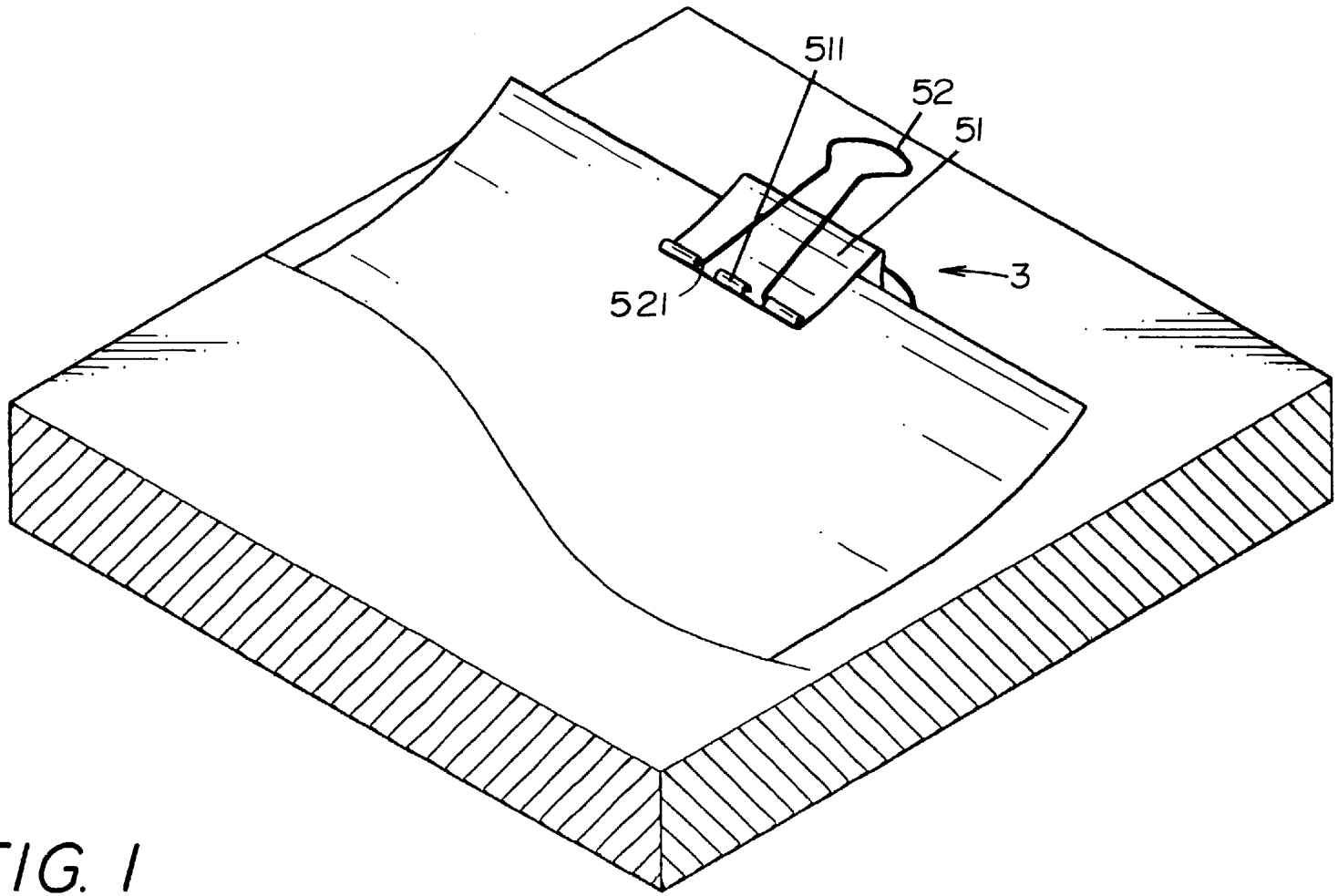
FIG. 1 (PRIOR ART)
FIG. 1 is an isometric drawing of a conventional binder clip.
Figure 2:
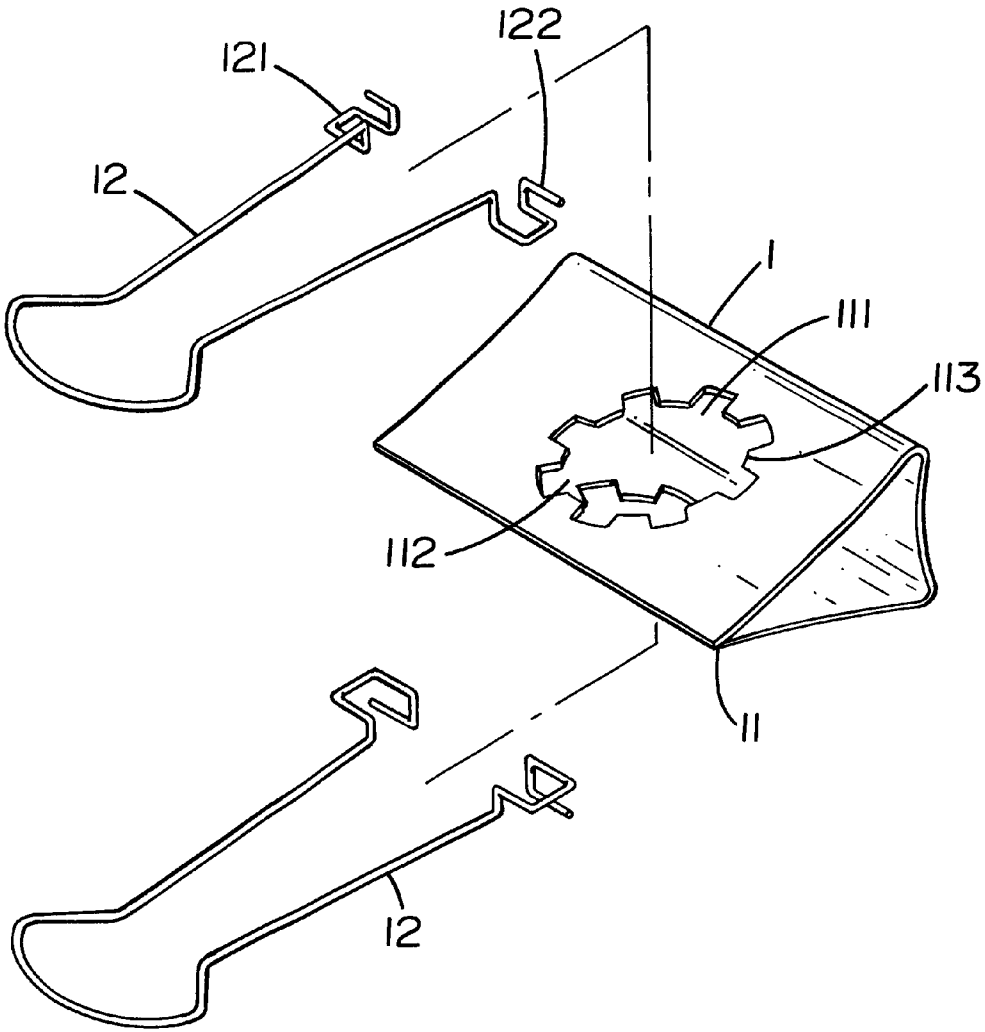
FIG. 2 is an isometric drawing of die binder clip of die invention herein.
Figure 3:
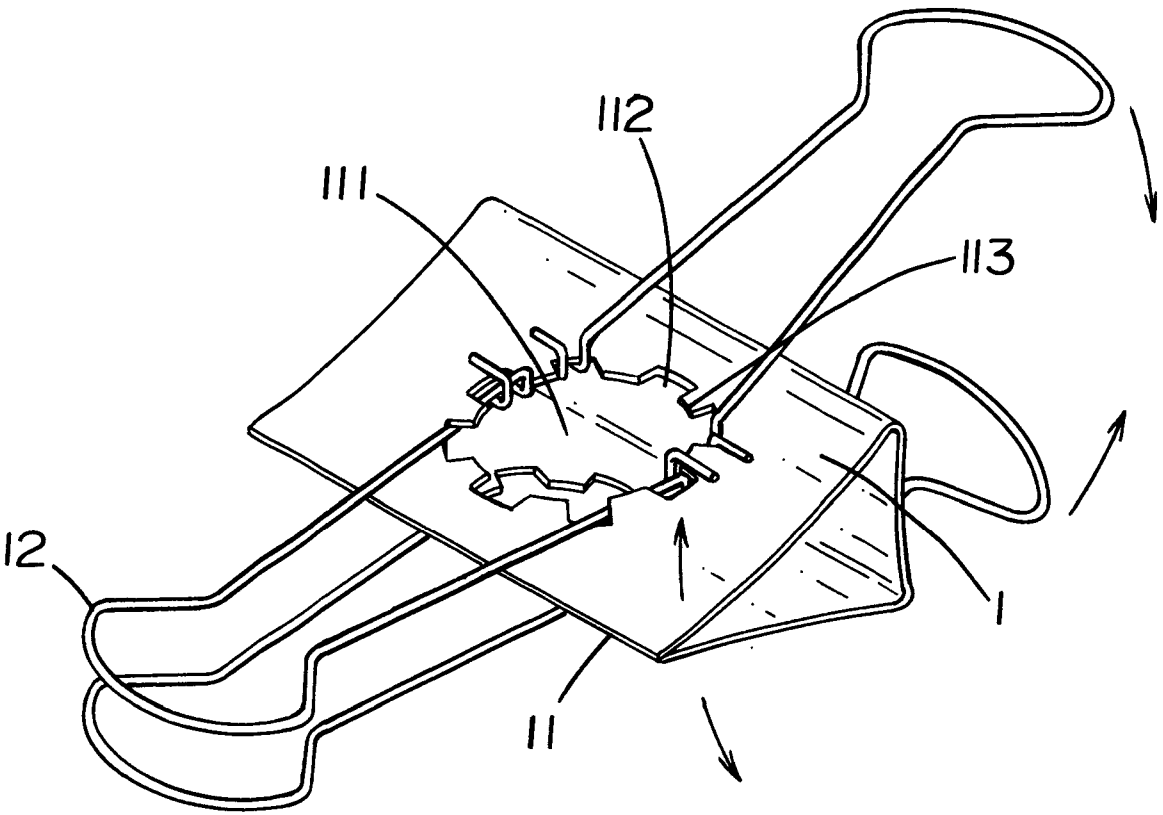
FIG. 3 is an isometric drawing of die invention herein.

Referring to FIG. 2 and FIG. 3, wherein the structural entity of the present invention is clearly illustrated, the binding clip 1 of the invention herein is comprised of a triangularly folded pincer section 11 and an actuator rod 12 on each of the two sides of the pincer section 11.

Of which, an insertion hole 111 is punched in each of the two sides of the pincer section and, furthermore, an even number of oppositely facing limiter notches 112 are formed along the inner circumference of the insertion hole 111 and a rounded guide element 113 is disposed in between each of the limiter notches 112, thereby providing for the rotation of the actuator rods 11 along the rounded guide elements 113.

Each of the said actuator rods 12 consists of a U-shaped rod structure with the two ends bent to an appropriate angular degree and, furthermore, the resulting catch hooks 122 extending from the bent section 121 formed on the two ends of the actuator rods 12, by means of the metallic resilience produced by pressing the two sides of the actuator rods 12 inward, enable the catch hooks 122 to become engaged into opposing pairs of limiter notches 112 and, furthermore, the actuator rods 12 remain filly pivotable while positioned in the limiter notches 112.

Figure 4:
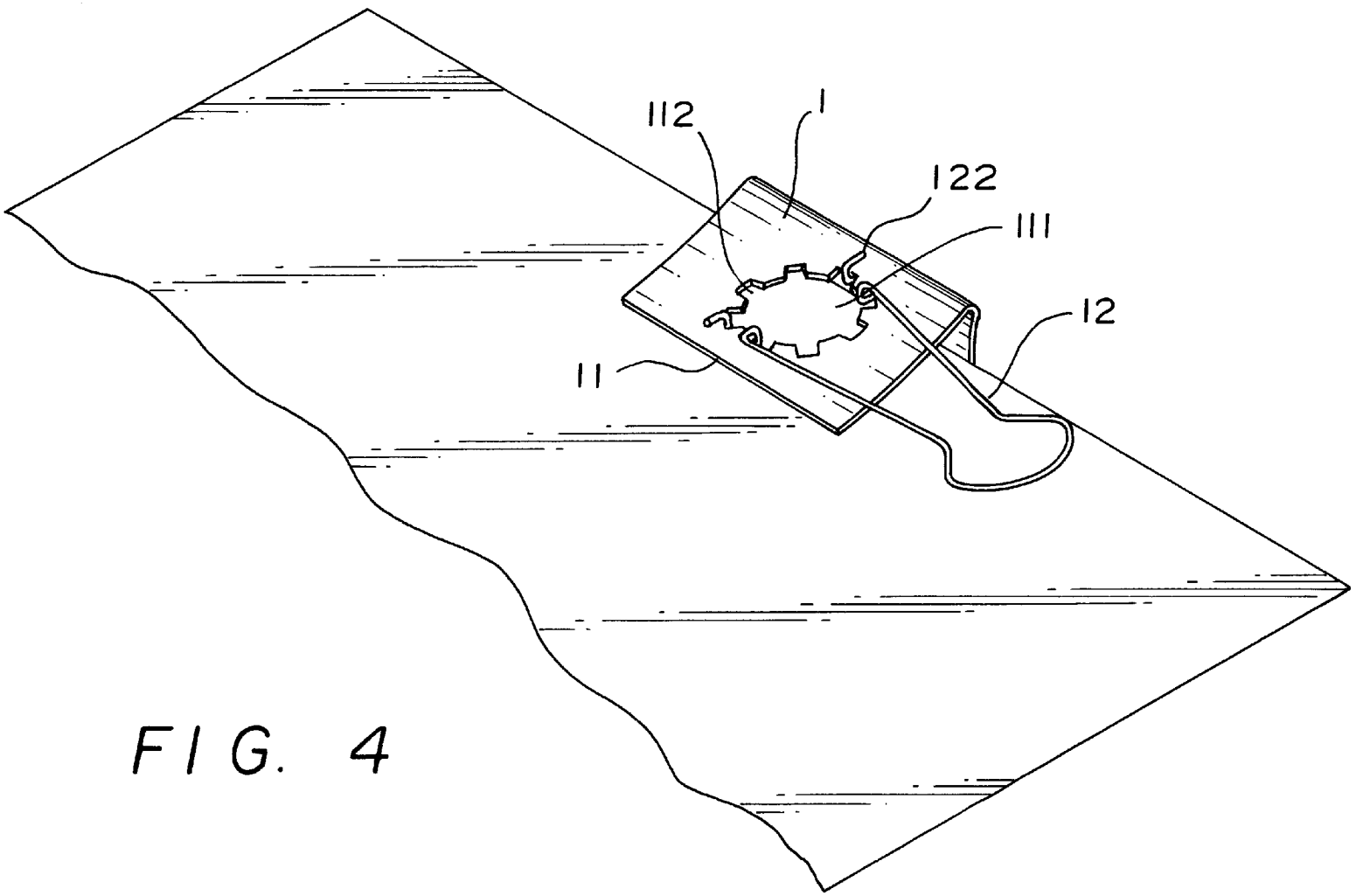
FIG. 4 is an isometric drawing of an embodiment of the invention herein that illustrates the rotating capability of actuator rods.

Referring to FIG. 4, the catch hooks 122 of the said actuator rods 12 are squeezed inward and thereby engaged into the limiter notches 112 of the pincer section 11 and, furthermore, can be positioned to any angular degree by rotation along the rounded guide elements 113 between each of the limiter notches 112 and, therefore, the actuator rods 12 are capable of being rotated such that they are postured laterally to the sides of the pincer section 11 and thereby circumvent the excessive protuberance shortcoming of the pincer section of the conventional binding clip 3 due to the fixed upward or downward pivoting range of its hinged actuator rods and, furthermore, reading and writing by the user will not be impaired after the actuator rods 12 are pivoted down; additionally, in the binding clip 1 of the invention herein, since the pincer section 11 and the actuator rods 12 are engaged together in a manner that only requires the punching of the insertion holes 111 in the pincer section 11 and the appropriate bending of the actuator arms 12, it is not necessary to form the hinge folds 511 as on the pincer section of the conventional binding clip 5, a shortcoming that involves greater punch die difficulty during fabrication; as such, the improved structure binding clip of the invention herein does not adversely affect reading and writing and, furthermore, its die fabrication is simpler.

In summation of the foregoing section, since the improved structure binding clip of the invention herein is innovative in construction and fully capable of achieving all claimed objectives and, furthermore, features offers more practical performance than the conventional product, the invention herein is hereby submitted in application for the granting the commensurate patent rights.

What is claimed is:

1. A binding clip comprising a triangularly folded pincer section with two opposite sides, and an actuator rod located on each of the two opposite sides of the pincer section, each opposite side having an insertion hole therethrough with an even number of oppositely facing limiter notches formed along an inner circumference of the insertion hole; each actuator rod having two ends bent to form catch hooks extending therefrom, the catch hooks removably engaging opposing pairs of said limiter notches such that said actuator rods are fully pivotable while engaged with the limiter notches and the actuator rods may be repositioned so as to not adversely affect reading and writing.

2. The binding clip of claim 1 further comprising a rounded guide element disposed between each adjacent pair of the limiter notches formed along the inner circumference of the insertion hole.

* * * * *